US011485135B2

(12) United States Patent
Nomura

(10) Patent No.: US 11,485,135 B2
(45) Date of Patent: Nov. 1, 2022

(54) PRINT ELEMENT SUBSTRATE, PRINTHEAD, AND PRINTING APPARATUS

(71) Applicant: CANON KABUSHIKI KAISHA, Tokyo (JP)

(72) Inventor: Hiroyasu Nomura, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/318,492

(22) Filed: May 12, 2021

(65) Prior Publication Data

US 2021/0379889 A1 Dec. 9, 2021

(30) Foreign Application Priority Data

Jun. 8, 2020 (JP) ..... JP2020-099609

(51) Int. Cl.
*B41J 2/05* (2006.01)
*B41J 2/045* (2006.01)

(52) U.S. Cl.
CPC ..... *B41J 2/05* (2013.01); *B41J 2/0458* (2013.01); *B41J 2/04563* (2013.01)

(58) Field of Classification Search
CPC .... B41J 2/0451; B41J 2/0458; B41J 2/04586; B41J 2/04563; B41J 2/05; B41J 2/14153
See application file for complete search history.

(56) References Cited

U.S. PATENT DOCUMENTS 10,906,303 B2 * 2/2021 Osanai ..... B41J 2/04541
10,960,665 B2 * 3/2021 Nomura ..... B41J 2/04541

FOREIGN PATENT DOCUMENTS

JP 2008-23987 A 2/2008

* cited by examiner

*Primary Examiner* — Thinh H Nguyen
(74) *Attorney, Agent, or Firm* — Venable LLP

(57) ABSTRACT

A print element substrate, comprising a plurality of heating elements, a plurality of detection elements, each configured to detect a temperature of a corresponding heating element, a first current generation unit, a second current generation unit, and a signal output unit, wherein one of the first and second current generation units supplies a current to a first detection element, the other supplies a current to a second detection element, and the signal output unit outputs a signal according to a potential difference between one terminal of the first detection element on a side where a potential variation occurs upon supply of the current and one terminal of the second detection element on a side where a potential variation occurs upon supply of the current.

10 Claims, 10 Drawing Sheets

PRINT ELEMENT SUBSTRATE, PRINTHEAD, AND PRINTING APPARATUS

BACKGROUND OF THE INVENTION

Field of the Invention

The present invention mainly relates to a print element substrate.

Description of the Related Art

Some printing apparatuses include a heating element as a print element configured to perform printing (see Japanese Patent Laid-Open No. 2008-23987). The heating element heats a liquid such as ink droplets to generate bubbles, thereby discharging the liquid from an orifice provided in a printhead. A resistive element is used as the heating element. The heating element is driven by energization and thus generates heat energy (note that the heating element can also be called an electrothermal transducer, a heater, or the like).

Japanese Patent Laid-Open No. 2008-23987 describes providing a detection element configured to detect whether a liquid is appropriately discharged in correspondence with a heating element. A resistive element is used as the detection element, and the electric resistance value of the element varies along with a temperature change caused by liquid discharge. It is therefore possible to determine, based on the voltage of the detection element, whether the liquid is appropriately discharged (the detection element can also be called a temperature sensor or the like). In this configuration, to improve the accuracy of detection, a further contrivance can be needed.

SUMMARY OF THE INVENTION

It is an exemplary object of the present invention to provide a technique advantageous in improving the accuracy of detecting whether a liquid is appropriately discharged.

One of the aspects of the present invention provides a print element substrate comprising a plurality of heating elements each capable of generating heat energy, a plurality of detection elements which correspond to the plurality of heating elements and each of which can detect a temperature of a corresponding heating element, a first current generation unit, a second current generation unit different from the first current generation unit, and a signal output unit, wherein one of the first current generation unit and the second current generation unit supplies a current to a first detection element in the plurality of detection elements, the other of the first current generation unit and the second current generation unit supplies a current to a second detection element in the plurality of detection elements, and the signal output unit outputs a signal according to a potential difference between one terminal of the first detection element on a side where a potential variation occurs upon supply of the current and one terminal of the second detection element on a side where a potential variation occurs upon supply of the current.

Further features of the present invention will become apparent from the following description of exemplary embodiments (with reference to the attached drawings).

DESCRIPTION OF THE EMBODIMENTS

Figure 1:
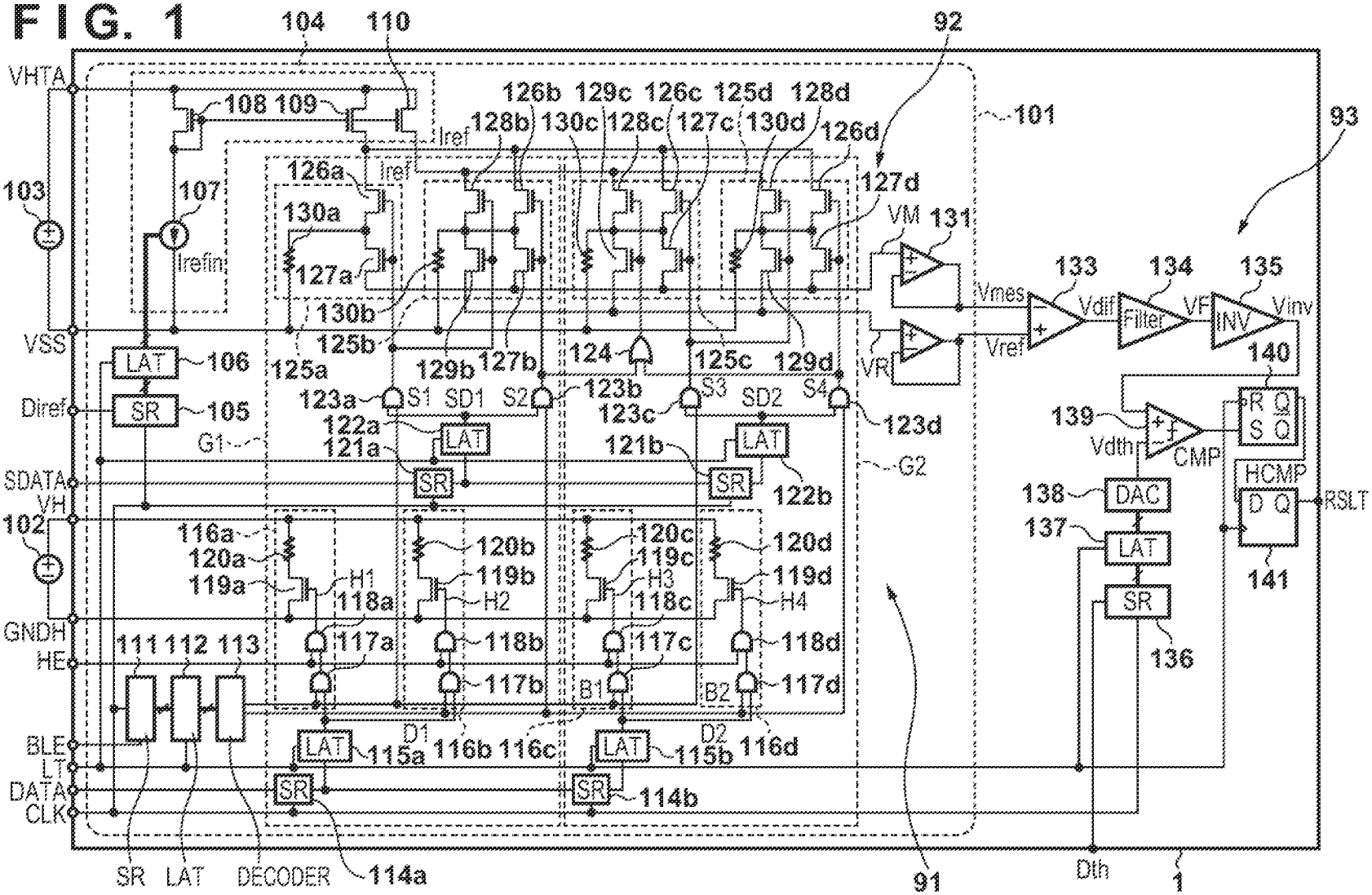
FIG. 1 is a circuit diagram showing an example of the configuration of a print element substrate.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

(Outline of Printing Apparatus) The outline of an inkjet type printing apparatus 801 according to the embodiment will be described with reference to FIGS. 8A and 8B.

Figure 8A:
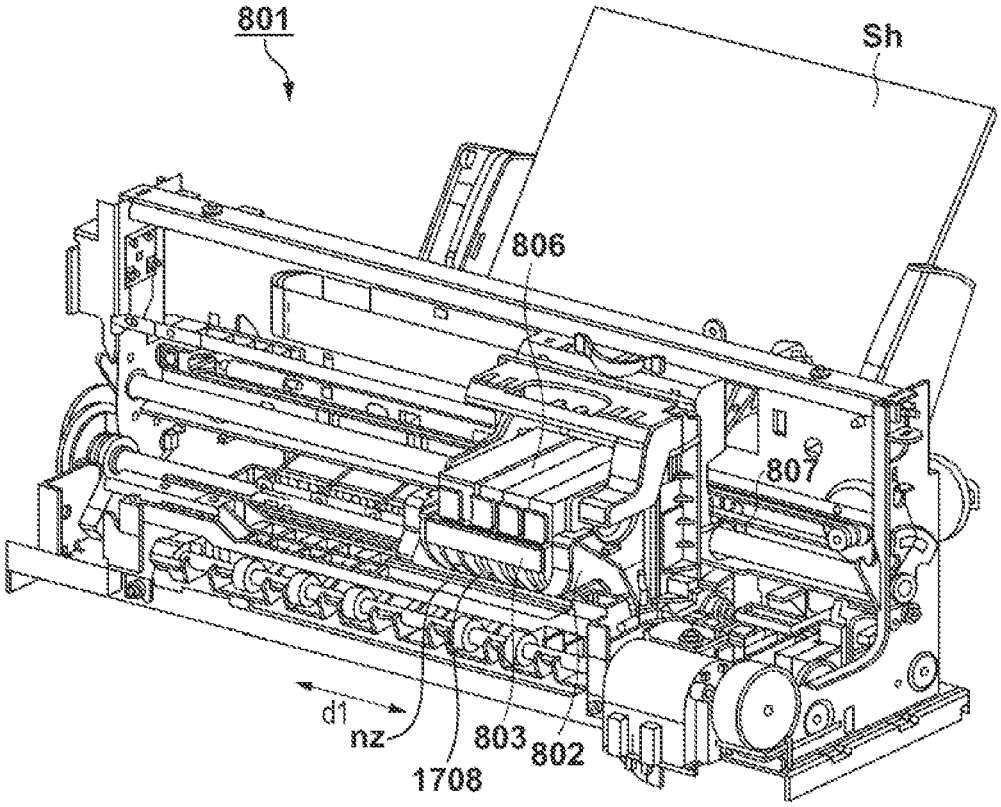
FIG. 8A is a perspective view showing the whole printing apparatus.

FIG. 8A is a perspective view showing an example of the outer appearance of the printing apparatus 801. In the printing apparatus 801, a printhead 1708 configured to discharge ink (liquid) to perform printing is mounted on a carriage 802, and the carriage 802 is reciprocally moved in the direction of an arrow dl, thereby performing printing. The printing apparatus 801 includes a conveyance mechanism 807. The conveyance mechanism 807 conveys a print medium Sh to a predetermined position. As the print medium Sh, a sheet made of a paper material or the like can be used. The printhead 1708 discharges ink to the print medium Sh at the predetermined position, thereby performing printing.

In addition to the printhead 1708, for example, an ink cartridge 806 is mounted on the carriage 802. The ink cartridge 806 stores ink to be supplied to the printhead 1708. The ink cartridge 806 is detachably installed on the carriage 802. In addition, the printing apparatus 801 can perform color printing. Hence, four ink cartridges that stores magenta (M), cyan (C), yellow (Y), and black (K) inks, respectively, are mounted on the carriage 802. The four ink cartridges can independently be attached/detached.

The printhead 1708 is provided with a plurality of nozzles nz configured to discharge ink. The printhead 1708 includes a print element substrate including a plurality of print elements provided in correspondence with the plurality of nozzles nz. As will be described later in detail, a pulse voltage according to a print signal is applied to a print element, and a corresponding nozzle nz is thus driven, and ink is discharged from the nozzle nz. In this embodiment, a heating element is used as the print element.

Figure 8B:
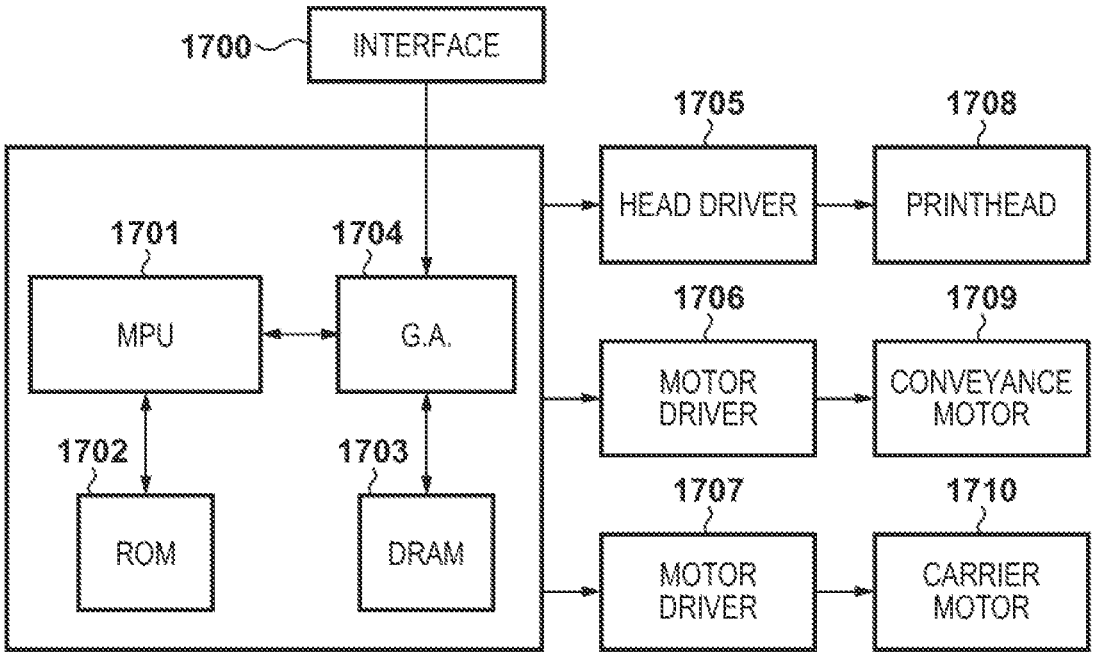
FIG. 8B is a block diagram showing the system configuration of the printing apparatus.

FIG. 8B shows the system configuration of the printing apparatus 801. The printing apparatus 801 includes an interface 1700, an MPU 1701, a ROM 1702, a RAM 1703, and a gate array 1704. A print signal is input to the interface 1700. The ROM 1702 stores a control program to be executed by the MPU 1701. The RAM 1703 stores various kinds of data such as the above-described print signal and print data supplied to the printhead 1708. The gate array 1704 performs supply control of print data to the printhead 1708, and also controls data transfer between the interface 1700, the MPU 1701, and the RAM 1703.

The printing apparatus 801 also includes a printhead driver 1705, motor drivers 1706 and 1707, a conveyance motor 1709, and a carrier motor 1710. The printhead driver 1705 drives the printhead 1708. The motor drivers 1706 and 1707 drive the conveyance motor 1709 and the carrier motor 1710, respectively. The conveyance motor 1709 drives the conveyance mechanism 807 to cause it to convey the print medium Sh. The carrier motor 1710 conveys the printhead 1708.

When a print signal is input to the interface 1700, the print signal can be converted into print data of a predetermined format between the gate array 1704 and the MPU 1701. The mechanisms are driven and controlled in accordance with the print data, and desired printing is thus implemented.

Figure 7:
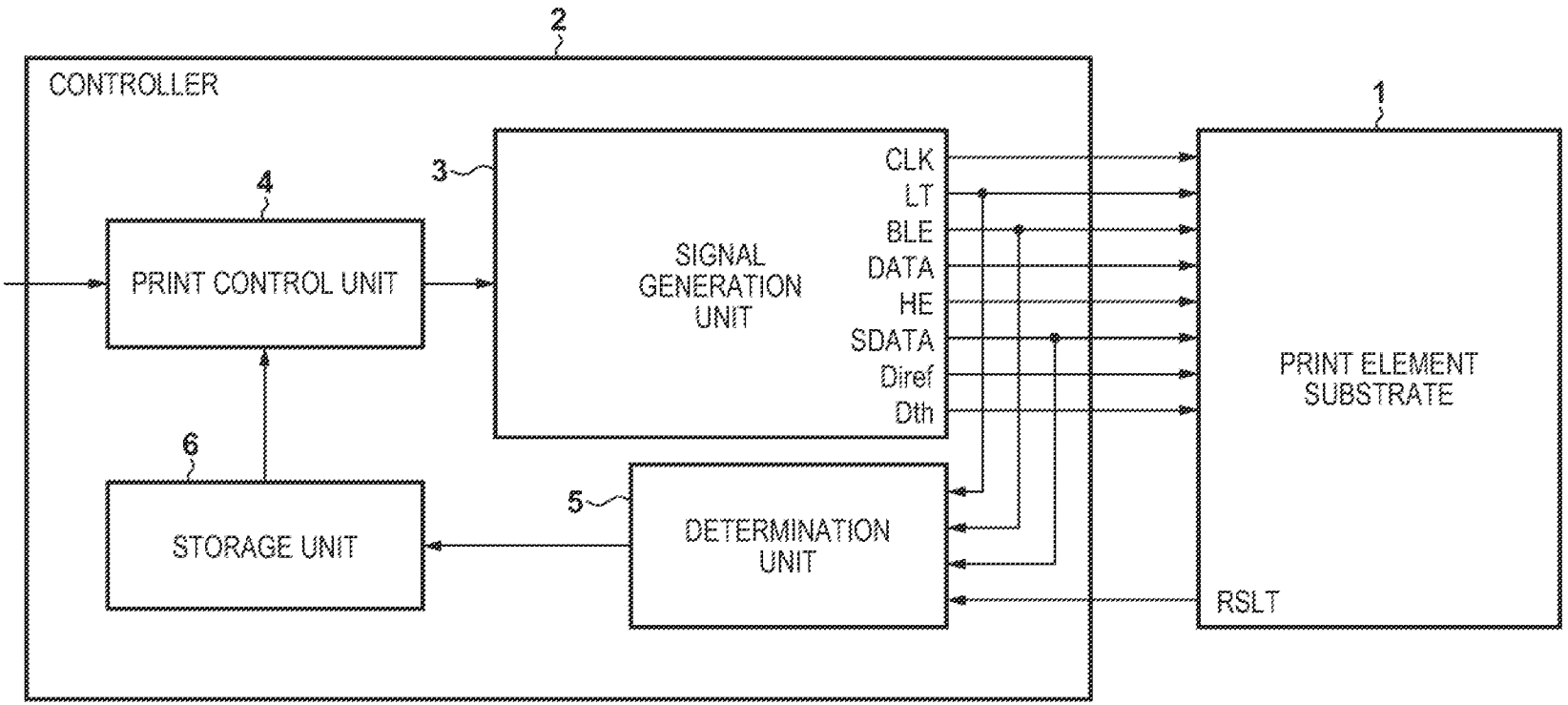
FIG. 7 is a block diagram showing the configuration of a printing apparatus.

FIG. 7 shows an example of the configuration of the printing apparatus 801 according to the embodiment. The printing apparatus 801 includes a print element substrate 1 and a controller 2. The print element substrate 1 is incorporated in the printhead 1708, and performs driving control of the printhead 1708 configured to form an image on the print medium Sh. Note that the concept of an image includes not only a character, a symbol, a graphic, and a photo but also a blank that can be formed therebetween. Further details of the print element substrate 1 will be described later.

The controller 2 includes a signal generation unit 3, a print control unit 4, a determination unit 5, and a storage unit 6, and performs driving control of the printhead 1708 by exchanging signals with the print element substrate 1. A command (also called a job or the like) for instructing execution of printing of an image on the print medium Sh is input from an external device (not shown) to the print control unit 4. This command includes image data representing the information of an image and also includes additional information for execution of printing. Based on the command from the external device (not shown), the print control unit 4 outputs driving data used to drive the printhead 1708 to the signal generation unit 3. Note that the external device is a computer communicable with the printing apparatus 801 by a wire or wirelessly, and can be expressed as a host device or the like.

The signal generation unit 3 generates a plurality of signals (to be described later) based on data from the print control unit 4, and outputs these to the print element substrate 1. As will be described later in detail, the determination unit 5 receives a determination signal RSLT from the print element substrate 1 and performs predetermined determination. The determination result of the determination unit 5 is stored in the storage unit 6. The print control unit 4 processes print data based on the determination result stored in the storage unit 6 (for example, performs complementary processing, correction processing, or the like), generates the data, and outputs it to the signal generation unit 3.

Note that the controller 2 is provided in the main body of the printing apparatus 801 (outside the printhead 1708), but may be incorporated in the printhead 1708. In addition, the controller 2 may be expressed as a head controller or the like for the sake of discrimination from other controllers.

(Configuration Example of Print Element Substrate)

FIG. 1 is a simple circuit diagram showing an example of the configuration of the print element substrate 1. In a region 101 corresponding to the plurality of nozzles nz, the print element substrate 1 includes a heating unit 91, a temperature detection unit 92, and a current supply unit 104.

The heating unit 91 includes a plurality of (four in this embodiment) heating elements 120*a* to 120*d* and a plurality of driving elements 119*a* to 119*d*. Note that in the following description, if discrimination is not particularly needed, the heating elements 120*a* to 120*d* can be simply referred to as heating elements 120, and the plurality of driving elements 119*a* to 119*d* can be simply referred to as driving elements 119.

The heating element 120*a* and the driving element 119*a* are electrically connected in series between voltages VH and GNDH. This also applies to the heating element 120*b* and the driving element 119*b*, the heating element 120*c* and the driving element 119*c*, and the heating element 120*d* and the driving element 119*d*. The plurality of heating elements 120 are resistive elements provided in correspondence with the plurality of nozzles nz, are driven by energization, and thus generate heat energy. The driving elements 119 are, for example, switch elements such as MOS (Metal Oxide Semiconductor) transistors. Each driving element 119 drives the corresponding heating element 120 in a conductive state, and suppresses the driving in a non-conductive state. With this configuration, the driving elements 119*a* to 119*d* drive the heating elements 120*a* to 120*d* based on signals H1 to H4, respectively. Note that a voltage source 102 is connected between the voltages VH and GNDH.

Also, logic units (AND circuits) 117*a* and 118*a* are provided for the heating element 120*a* and the driving element 119*a*, and these are integrated into an element 116*a*. This also applies to element 116*b*, 116*c*, and 116*d* shown in FIG. 1.

The plurality of heating elements 120 are time-divisionally driven. This driving can also be expressed as time division driving or the like. The time division driving is performed by dividing the plurality of heating elements into two or more groups and driving some heating elements in each group on a group basis.

For example, let i be the number of groups (i is an integer of 2 or more), and j be the number of heating elements in each group (j is an integer of 2 or more). In this case, first, i first heating elements in each of the first, second, . . . , and ith groups are simultaneously driven. Next, i second heating elements in each of the first, second, . . . , and ith groups are simultaneously driven, and third, fourth, . . . , and jth heating elements are sequentially driven in accordance with the same procedure. Note that i heating elements simultaneously driven in the time division driving are also called "time division block" or simply "block", or the like.

In this embodiment, i=2 and j=2 are set to facilitate understanding. The element 116*a* including the heating element 120*a* and the element 116*b* including the heating element 120*b* form a group G1, and the element 116*c* including the heating element 120*c* and the element 116*d* including the heating element 120*d* form a group G2.

As will be described later in detail, a shift register 114*a* and a latch circuit 115*a* are arranged in the group G1, and a shift register 114*b* and a latch circuit 115*b* are arranged in the group G2.

The temperature detection unit 92 includes a plurality of detection elements 130*a* to 130*d*, and a plurality of switch elements 126*a* to 126*d*, 127*a* to 127*d*, 128*b* to 128*d*, and 129*b* to 129*d*. MOS transistors or the like can be used as the switch element 126*a* and the like, like the driving elements 119. Note that in the following description, if discrimination is not particularly needed, the detection elements 130*a* to 130*d* can be simply referred to as detection elements 130.

The switch elements 126*a* and 127*a* are electrically connected in series, one terminal of the detection element 130*a* is connected between the switch elements 126*a* and 127*a*, and the other terminal is fixed to a voltage VSS. The elements 126*a*, 127*a*, and 130*a* are integrated into an element 125*a*.

The switch elements 126*b* and 127*b* are electrically connected in series. The switch elements 128*b* and 129*b* are electrically connected in series. One terminal of the detection element 130*b* is connected between the switch elements 126*b* and 127*b* and also connected between the switch elements 128*b* and 129*b*, and the other terminal is fixed to the voltage VSS. The elements 126*b*, 127*b*, 128*b*, 129*b*, and 130*b* are integrated into an element 125*b*. This also applies to elements 125*c* and 125*d* shown in FIG. 1.

The elements 125*a* and 125*b* correspond to the group G1, and the elements 125*c* and 125*d* correspond to the group G2.

The plurality of detection elements 130 are resistive elements provided in correspondence with the plurality of heating elements 120, and change the electric resistance value by heat energy generated by the corresponding heating elements 120. The detection element 130 functions as a temperature sensor configured to detect the temperature.

For example, in the element 125*b*, when the switch element 126*b* is set in the conductive state, the detection element 130*b* generates a voltage $V_M$ according to the electric resistance value. When the switch element 127*b* is set in the conductive state, the voltage $V_M$ is output as a signal (to be sometimes referred to as a signal $V_M$) representing the temperature detection result. In addition, when the switch element 128*b* is set in the conductive state, the detection element 130*b* generates a voltage $V_R$ according to the electric resistance value. When the switch element 129*b* is set in the conductive state, the voltage $V_R$ is output as a signal (to be sometimes referred to as a signal $V_R$) representing the temperature detection result.

As will be described later in detail, a shift register 121*a*, a latch circuit 122*a*, and logic units (AND circuits) 123*a* and 123*b* are arranged in the group G1, and a shift register 121*b*, a latch circuit 122*b*, and logic units (AND circuits) 123*c* and 123*d* are arranged in the group G2. Also, a logic unit (OR circuit) 124 is arranged in the group G1 or G2.

The current supply unit 104 includes a current source 107, and transistors 108, 109, and 110. The current source 107 and the transistor 108 are electrically connected in series between voltages VHTA and VSS. The transistors 109 and 110 are arranged to form a current mirror circuit with respect to the transistor 108. The current source 107 generates a desired current Irefin based on a signal from a latch circuit 106 to be described later. Note that the voltage source 103 is connected between the voltages VHTA and VSS.

The transistor 109 functions as a first current generation unit and generates a current Iref according to the current Irefin, and the current Iref can be supplied to the switch elements 126*a*, 126*b*, 126*c*, and 126*d*.

Similarly, the transistor 110 functions as a second current generation unit and generates the current Iref according to the current Irefin, and the current Iref can be supplied to the switch elements 128*b*, 128*c*, and 128*d*.

In the region 101, the print element substrate 1 further includes a shift register 105, the latch circuit 106, a shift register 111, a latch circuit 112, a decoder 113, and buffer circuits (voltage follower circuits) 131 and 132.

The shift register 105 receives a reference current signal (data) Diref and sequentially transfers it/these based on a clock signal CLK. The latch circuit 106 latches, based on a latch signal LT, the signal transferred from the shift register 105. The current source 107 generates the current Irefin according to the latched signal.

The shift register 111 receives a block signal (block data) BLE and sequentially transfers it/these based on the clock signal CLK. The latch circuit 112 latches, based on the latch signal LT, the signal transferred from the shift register 111. The decoder 113 outputs signals B1 and B2 based on the latched signal, that is, decodes the block signal BLE into the signals B1 and B2.

In the group G1, a shift register 114*a* receives a data signal DATA based on image data, and sequentially transfers it/these based on the clock signal CLK. A latch circuit 115*a* latches, based on the latch signal LT, the signal transferred from the shift register 114*a*, and outputs a signal D1.

A logic unit 117*a* outputs an AND based on the signals B1 and D1. A logic unit 118*a* outputs an AND based on the output signal from the logic unit 117*a* and a heat enable signal HE as a signal H1. Similarly, a logic unit 117*b* outputs an AND based on the signals B2 and D1. A logic unit 118*b* outputs an AND based on the output signal from the logic unit 117*b* and the heat enable signal HE as a signal H2.

Similarly, in the group G2, a shift register 114*b* receives the data signal DATA, and sequentially transfers it/these based on the clock signal CLK. A latch circuit 115*b* latches, based on the latch signal LT, the signal transferred from the shift register 114*b*, and outputs a signal D2.

A logic unit 117*c* outputs an AND based on the signals B1 and D2. A logic unit 118*c* outputs an AND based on the output signal from the logic unit 117*c* and the heat enable signal HE as a signal H3. Similarly, a logic unit 117*d* outputs an AND based on the signals B2 and D2. A logic unit 118*d* outputs an AND based on the output signal from the logic unit 117*d* and the heat enable signal HE as a signal H4.

With this configuration, in the heating unit 91, the plurality of heating elements 120 are time-divisionally driven.

On the other hand, as for the temperature detection unit 92, in the group G1, the shift register 121*a* receives a temperature detection signal (data) SDATA, and sequentially transfers it/these based on the clock signal CLK. The latch circuit 122*a* latches, based on the latch signal LT, the signal transferred from the shift register 121*a*, and outputs a signal SD1. The logic unit 123*a* outputs an AND based on the signals B1 and SD1 as a signal S1, and the logic unit 123*b* outputs an AND based on the signals B2 and SD1 as a signal S2.

In the group G2, the shift register 121*b* receives the signal SDATA, and sequentially transfers it/these based on the clock signal CLK. The latch circuit 122*b* latches, based on the latch signal LT, the signal transferred from the shift register 121*b*, and outputs a signal SD2. The logic unit 123*c* outputs an AND based on the signals B1 and SD2 as a signal S3, and the logic unit 123*d* outputs an AND based on the signals B2 and SD2 as a signal S4.

The logic unit 124 outputs an OR (S2+S4) based on the signal S2 from the group G1 and the signal S4 from the group G2.

The signal S1 is supplied to the control terminals (gates in this embodiment) of the switch elements 126*a*, 127*a*, 128*b*, and 129*b*. The signal S2 is supplied to the control terminals of the switch elements 126*b* and 127*b*. The signal S3 is supplied to the control terminals of the switch elements 126*c*, 127*c*, 128*d*, and 129*d*. The signal S4 is supplied to the control terminals of the switch elements 126*d* and 127*d*. In addition, the OR (S2+S4) is supplied to the control terminals of the switch elements 128*c* and 129*c*.

With this configuration, in the temperature detection unit 92, the plurality of detection elements 130 output the signals $V_M$ and $V_R$ corresponding to the time division driving of the heating elements 120. The buffer circuit 131 circuit-separates the signal $V_M$ and outputs it as a signal Vmes to a differential amplifier 133 (to be described later), and the buffer circuit 132 circuit-separates the signal $V_R$ and outputs it as a signal Vref to the differential amplifier 133 (to be described later).

Figure 6:
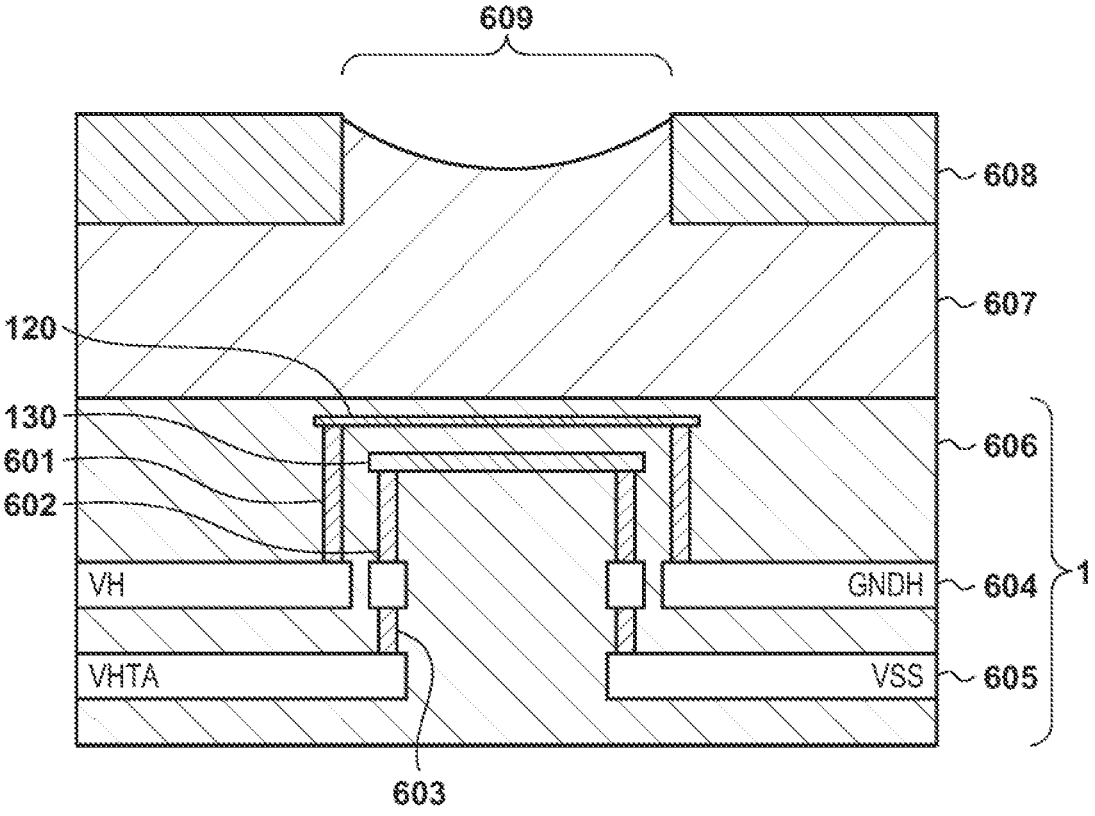
FIG. 6 is a schematic sectional view showing a part of the print element substrate and a part of a printhead.

FIG. 6 is a schematic sectional view showing a part of the print element substrate 1 and a part of the printhead 1708. The print element substrate 1 includes a first wiring layer 605, a second wiring layer 604, and an insulating member 606 that incorporates s these. Power supply lines that form the voltages VHTA and VSS are arranged in the wiring layer 605, and power supply lines that form the voltages VH and GNDH are arranged in the wiring layer 604. An orifice plate 608 is arranged above the print element substrate 1 to form a channel 607 of ink, and an orifice 609 corresponding to each nozzle nz is provided in the orifice plate 608.

The heating element 120 and the detection element 130 are incorporated in the insulating member 606 on the side of the channel 607. In this embodiment, the heating element 120 is located above the detection element 130. Note that to facilitate understanding, elements (119, 126*a*, and the like) connected to the heating element 120 and the detection element 130 are not illustrated here. The heating element 120 is connected to the power supply lines arranged in the wiring layer 604 via contact plugs 601. The detection element 130 is connected to the power supply lines arranged in the wiring layer 605 via contact plugs 602, the wiring layer 604, and contact plugs 603.

This also applies to the remaining heating elements 120 and detection elements 130 although a single heating element 120 and a single detection element 130 are shown here. As described above, each of the detection elements 130 is provided to face a corresponding one of the heating elements 120 in a planar view. When the heating element 120 is driven, ink in the channel 607 immediately above the heating element 120 generates bubbles, and is discharged from the orifice 609. The detection element 130 receives heat from the heating element 120 and changes the electric resistance value.

Referring back to FIG. 1, outside the region 101, the print element substrate 1 further includes the differential amplifier 133, a filter circuit 134, and an inverting amplifier 135.

Figure 3A:
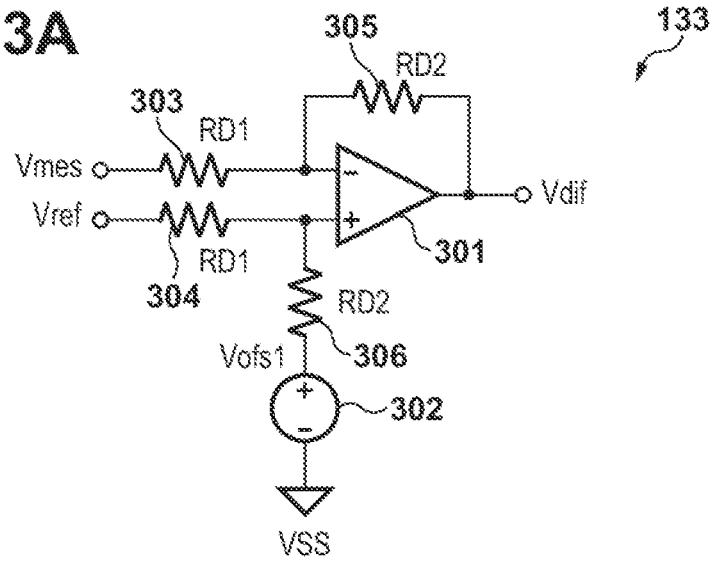
FIG. 3A is a circuit diagram showing an example of the configuration of a signal output unit.

FIG. 3A shows an example of the configuration of the differential amplifier 133. The differential amplifier 133 includes an operational amplifier 301, a voltage source 302, and a plurality of resistive elements 303 to 306. The signal Vmes is input to the inverting input terminal (indicated by "–" in FIG. 3A) of the operational amplifier 301 via the resistive element 303, and the signal Vref is input to the noninverting input terminal (indicated by "+" in FIG. 3A) via the resistive element 304. The resistive element 305 is arranged to form a feedback circuit between the output terminal and the inverting input terminal of the operational amplifier 301. In addition, the voltage source 302 is connected to the noninverting input terminal via the resistive element 306.

Here, when the heating element 120 is driven, the signal Vmes is output from the corresponding detection element 130 (to be referred to as a detection element 130mes for the sake of discrimination), and the signal Vref is output from another detection element 130 (to be referred to as a detection element 130ref for the sake of discrimination). The values (to be referred to as the voltages Vmes and Vref, respectively) of the signals Vmes and Vref are determined based on the electric resistance values of the detection elements 130mes and 130ref, respectively.

For the detection element 130mes, the corresponding heating element 120 is driven. Let T be the temperature of the detection element 130mes at that time, and Rs0 be the electric resistance value of the detection element 130 at room temperature TO. At this time, using a temperature resistance coefficient TCR of the detection element 130, an electric resistance value Rmes of the detection element 130mes is given by $$Rmes = Rs0 \times \{1 + TCR \times (T - T0)\}$$

Hence, the voltage *Vmes* is given by $$Vmes = Iref \times Rmes = Iref \times Rs0 \times \{1 + TCR \times (T - T0)\}$$

On the other hand, for the detection element 130ref, the corresponding heating element 120 is not driven. Hence, let Tini be the temperature (initial temperature) during that time. At this time, an electric resistance value Rref of the detection element 130ref is given by $$Rref = Rs0 \times \{1 + TCR \times (Tini - T0)\}$$

Hence, the voltage *Vref* is given by $$Vref = Iref \times Rref = Iref \times Rs0 \times \{1 + TCR \times (Tini - T0)\}$$

The differential amplifier 133 receives the voltages Vmes and Vref and outputs a signal Vdif. Let RD1 be the electric resistance value of the resistive elements 303 and 304, RD2 be the electric resistance value of the resistive elements 305 and 306, Vofs1 be the voltage generated by the voltage source 302, and Gdif be the gain of the operational amplifier 301. At this time, the value (voltage Vdif) of the output signal Vdif is given by $$Vdif = Gdif \times (Vref - Vmes) + Vofs1 = Vofs1 - Gdif \times Iref \times Rs0 \times TCR \times (T - Tini)$$

Note that the gain Gdif is given by $$Gdif = RD2/RD1$$

The voltage Vofs1 is preferably set such that a desired operation by the differential amplifier 133 can be implemented.

With this configuration, the differential amplifier 133 outputs the signal Vdif according to the difference between the signal Vmes from the buffer circuit 131 and the signal Vref from the buffer circuit 132 to the filter circuit 134.

Figure 3B:
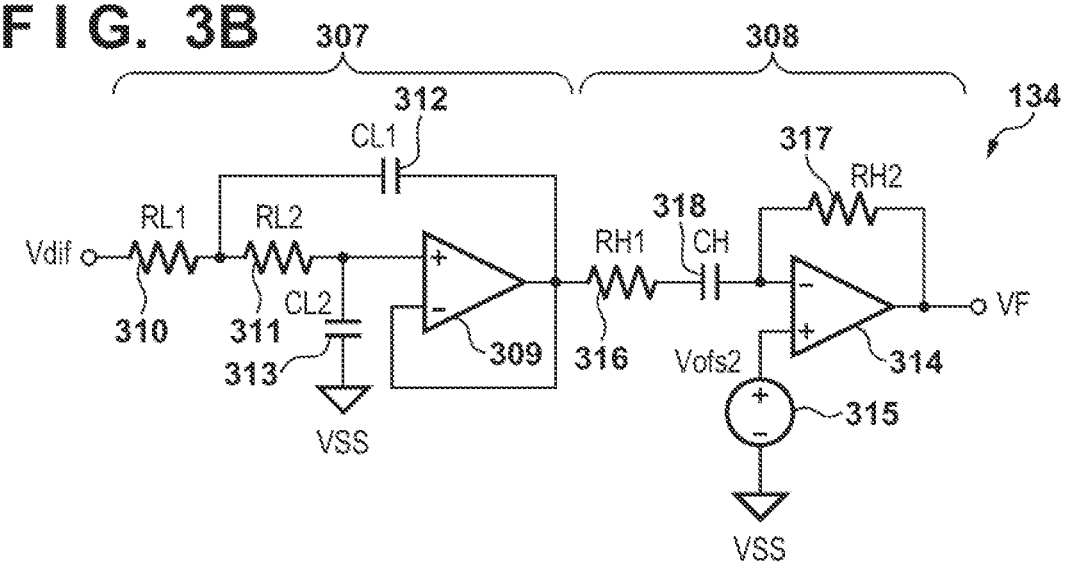
FIG. 3B is a circuit diagram showing an example of the configuration of the signal output unit.

FIG. 3B shows an example of the configuration of the filter circuit 134. The filter circuit 134 includes a secondary low-pass filter unit 307 and a primary high-pass filter unit 308.

The low-pass filter unit 307 includes an operational amplifier 309, a plurality of resistive elements 310 and 311, and a plurality of capacitors 312 and 313. The signal Vdif is input to the noninverting input terminal of the operational amplifier 309 via the resistive elements 310 and 311. The noninverting input terminal of the operational amplifier 309 is fixed to the voltage VSS via the capacitor 313. The capacitor 312 is arranged to form a feedback circuit between the output terminal of the operational amplifier 309 and the node between the resistive elements 310 and 311. The output terminal is connected to the inverting input terminal of the operational amplifier 309. Let RL1 be the electric resistance value of the resistive element 310, RL2 be the electric resistance value of the resistive element 311, CL1 be the capacitance value of the capacitor 312, and CL2 be the capacitance value of the capacitor 313.

Note that a cut-off frequency fcL of the low-pass filter unit 307 is given by $$fcL=\{2\times\pi\times(RL1\times RL2\times CL1\times CL2)^{1/2}\}^{-1}$$

The high-pass filter unit 308 includes an operational amplifier 314, a plurality of resistive elements 316 and 317, a capacitor 318, and a voltage source 315. The output terminal of the operational amplifier 309 is connected to the inverting input terminal of the operational amplifier 314 via the resistive element 316 and the capacitor 318. The resistive element 317 is arranged to form a feedback circuit between the output terminal and the inverting input terminal of the operational amplifier 314. The voltage source 315 is connected to the noninverting input terminal of the operational amplifier 314. Let RH1 be the electric resistance value of the resistive element 316, RH2 be the electric resistance value of the resistive element 317, CH be the capacitance value of the capacitor 318, and Vofs2 be the voltage generated by the voltage source 315.

Note that a cut-off frequency fcH of the high-pass filter unit 308 is given by $$fcH=(2\times\pi\times RH1\times CH)^{-1}$$

With this configuration, the filter circuit 134 filters the output signal Vdif (passes a frequency component of the signal Vdif within a predetermined range), and outputs the signal Vdif as a signal VF to the inverting amplifier 135 (the signal VF is represented by a voltage, and the value is expressed as the voltage VF). The value of the signal VF changes in proportion to an amplification factor GH (=RH2/RH1).

Figure 3C:
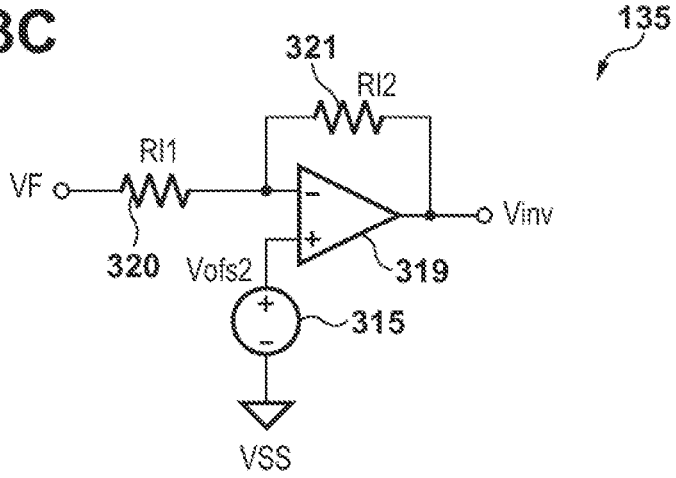
FIG. 3C is a circuit diagram showing an example of the configuration of the signal output unit.

FIG. 3C shows an example of the configuration of the inverting amplifier 135. The inverting amplifier 135 includes an operational amplifier 319, a plurality of resistive elements 320 and 321, and the voltage source 315 (the same as in the high-pass filter unit 308 (see FIG. 3B)). The signal VF is input to the inverting input terminal of the operational amplifier 319 via the resistive element 320. The resistive element 321 is arranged to form a feedback circuit between the output terminal and the inverting input terminal of the operational amplifier 319. The voltage source 315 is connected to the noninverting input terminal of the operational amplifier 319. Let RI1 be the electric resistance value of the resistive element 320, and RI2 be the electric resistance value of the resistive element 321. Again Ginv of the inverting amplifier 135 is given by $$Ginv=RI2/RI1$$

With this configuration, the inverting amplifier 135 inverts and amplifies the signal VF, and outputs it as a signal Vinv to a comparator 139 (to be described later) (the signal Vinv is represented by a voltage, and the value is expressed as the voltage Vinv). Using the gain Ginv of the inverting amplifier 135, the value of the signal Vinv is given by $$Vinv=Vofs2+Ginv\times(Vofs2-VF)$$

The voltage Vofs2 is preferably set such that a desired operation by the inverting amplifier 135 can be implemented.

Referring back to FIG. 1, outside the region 101, the print element substrate 1 further includes a shift register 136, a latch circuit 137, a digital/analog converter (DAC) 138, the comparator 139, an RS latch circuit 140, and a flip-flop circuit 141.

The shift register 136 receives reference value signal (data) Dth and sequentially transfers it/these based on the clock signal CLK. The latch circuit 137 latches, based on the latch signal LT, the signal transferred from the shift register 136. The DAC 138 digital/analog-converts (DA-converts) the latched signal, and outputs an analog signal Vdth (the signal Vdth is represented by a voltage, and the value is expressed as the voltage Vdth). Note that the signal Dth is, for example, an 8-bit signal group, and the signal Vdth can be set to an arbitrary value in, for example, 256 stages.

The comparator 139 compares the magnitudes of the signals Vinv and Vdth, and outputs a signal CMP representing the comparison result (the signal CMP is represented by a voltage, and the value is expressed as the voltage CMP). The RS latch circuit 140 latches the signal CMP based on the latch signal LT, and outputs the latched signal as a signal HCMP (the signal HCMP is represented by a voltage, and the value is expressed as the voltage HCMP). The flip-flop circuit 141 receives the signal HCMP, and outputs the determination signal RSLT based on the latch signal LT.

The differential amplifier 133, the filter circuit 134, the inverting amplifier 135, the shift register 136, the latch circuit 137, the DAC 138, the comparator 139, the RS latch circuit 140, and the flip-flop circuit 141 are integrated into a signal output unit 93.

With this configuration, the signal RSLT representing the detection result by the detection element 130 is output from the signal output unit 93 of the print element substrate 1 to the determination unit 5 of the controller 2 (see FIG. 1). The controller 2 performs driving control of the printhead 1708 based on the signal RSLT. Note that the individual units, circuits, elements, and the like exemplified in the above description may be changed without departing from the scope, and known ones may be used.

Figure 2:
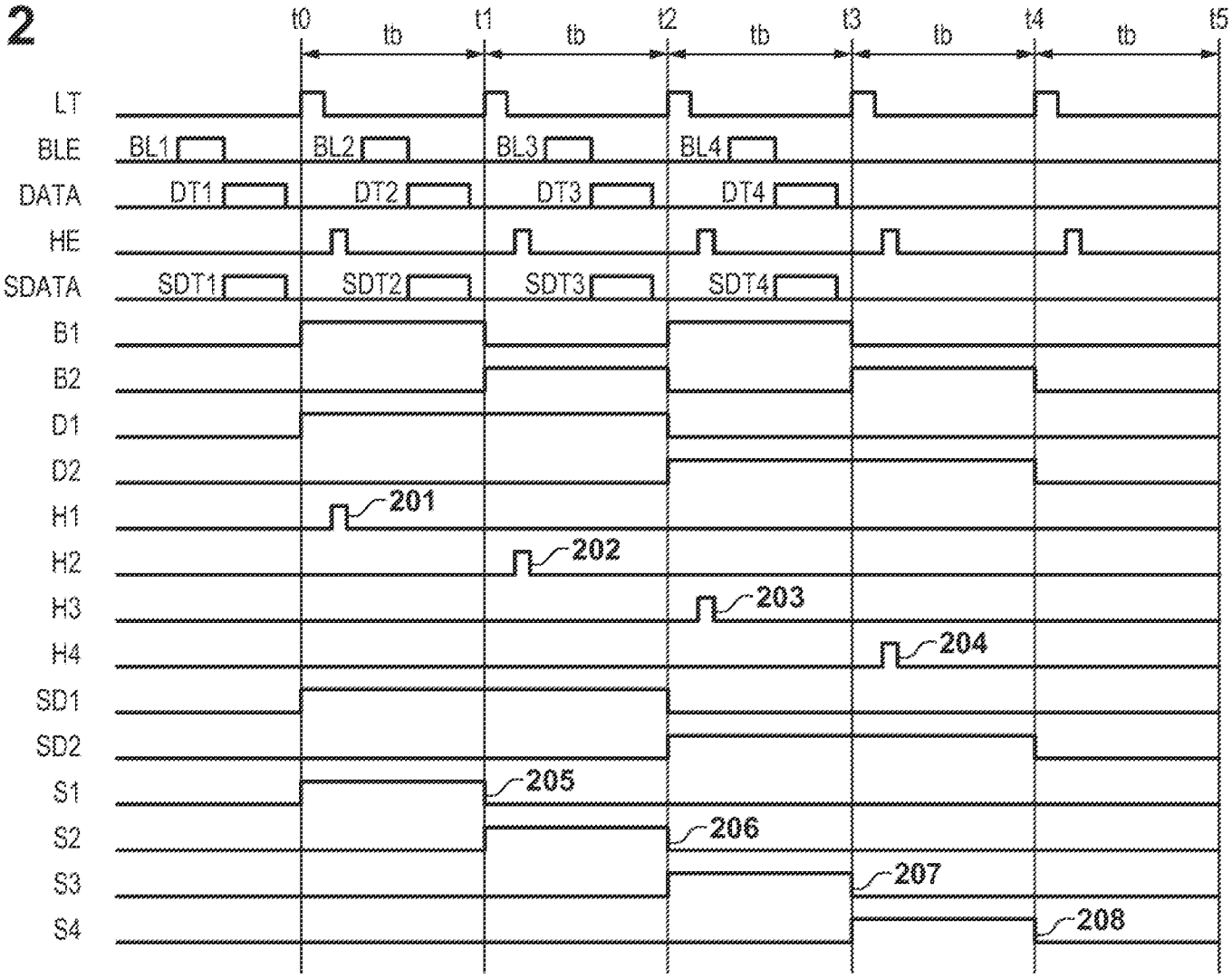
FIG. 2 is a timing chart showing a driving mode of the print element substrate.

FIG. 2 is a timing chart showing a driving mode of the print element substrate 1. The abscissa of FIG. 2 is the time base, and the ordinate shows the values (voltage values) of the signals LT, BLE, DATA, HE, SDATA, B1 and B2, D1 and D2, H1 to H4, SD1 and SD2, and S1 to S4. As for a signal value, an active level is high level (H level), and an inactive level is low level (L level).

For the latch signal LT, a pulse signal that changes to H level for a predetermined period is applied at a period tb. Similarly, the pulse signal of the heat enable signal HE is applied at the period tb next to the pulse signal of the latch signal LT.

As the block signal BLE, signals BL1, BL2, BL3, and BL4 are sequentially applied at the period tb. Similarly, as the data signal DATA, signals DT1, DT2, DT3, and DT4 are sequentially applied, and as the temperature detection signal SDATA, signals SDT1, SDT2, SDT3, and SDT4 are sequentially applied.

Based on the above-described signals, the signal H1 exhibits a waveform 201 of H level from time t0 to t1. Similarly, the signal H2 exhibits a waveform 202 of H level from time t1 to t2, the signal H3 exhibits a waveform 203 of H level from time t2 to t3, and the signal H4 exhibits a waveform 204 of H level from time t3 to t4.

Also, based on the above-described signals, the signal SD1 changes to H level from time t0 to t2, and the signal SD2 changes to H level from time t3 to t4. The signal S1 exhibits a waveform 205 of H level from time t0 to t1, the signal S2 exhibits a waveform 206 of H level from time t1 to t2, the signal S3 exhibits a waveform 207 of H level from time t2 to t3, and the signal S4 exhibits a waveform 208 of H level from time t3 to t4.

That is, according to this embodiment, the heating elements 120*a* to 120*d* are sequentially driven based on the signals H1 to H4, and during this time, the detection elements 130*a* to 130*d* are sequentially driven based on the signals S1 to S4.

More specifically, first, the heating element 120*a* is driven from time t0 to t1. During this time, the voltage of one terminal of the corresponding detection element 130*a* is output as the signal $V_M$ via the switch element 127*a*, and the voltage of one terminal of another detection element 130*b* is output as the signal $V_R$ via the switch element 129*b*.

Next, the heating element 120*b* is driven from time t1 to t2. During this time, the voltage of one terminal of the corresponding detection element 130*b* is output as the signal $V_M$ via the switch element 127*b*, and the voltage of one terminal of another detection element 130*c* is output as the signal $V_R$ via the switch element 129*c*.

After that, the heating element 120*c* is driven from time t2 to t3. During this time, the voltage of one terminal of the corresponding detection element 130*c* is output as the signal $V_M$ via the switch element 127*c*, and the voltage of one terminal of another detection element 130*d* is output as the signal $V_R$ via the switch element 129*d*.

Finally, the heating element 120*d* is driven from time t3 to t4. During this time, the voltage of one terminal of the corresponding detection element 130*d* is output as the signal $V_M$ via the switch element 127*d*, and the voltage of one terminal of another detection element 130*c* is output as the signal $V_R$ via the switch element 129*c*.

Note that the other terminal of each of the detection elements 130*a* to 130*d* is fixed to the voltage VSS, as described above.

Figure 5:
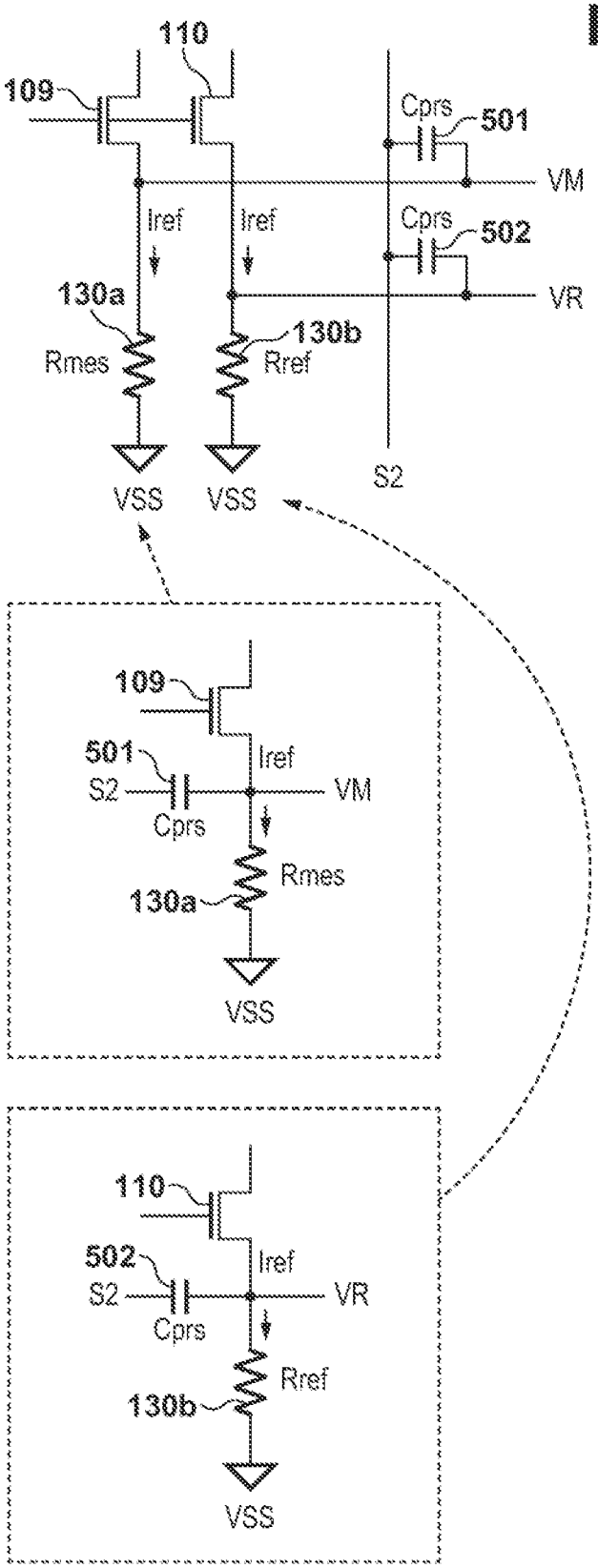
FIG. 5 is an equivalent circuit diagram for explaining noise superimposed on the signal output unit.

FIG. 5 is an equivalent circuit diagram for explaining noise superimposed on the signal output unit 93. From time t0 to t1, the detection element 130*a* is a temperature detection target (corresponds to the above-described detection element 130mes), and the detection element 130*b* is a comparison target (corresponds to the above-described detection element 130ref). That is, the electric resistance value of the detection element 130*a* is represented by Rmes, and the electric resistance value of the detection element 130*b* is represented by Rref.

Here, as shown in a partially enlarged view, a parasitic capacitor 501 (capacitance value Cprs) can be formed between the signal line of the signal S2 and the signal line of the signal $V_M$. The detection element 130*a* and the parasitic capacitor 501 form a high-pass filter, and its cut-off frequency fcHM is given by $$fcHM=(2\times\pi\times Rmes\times Cprs)^{-1}$$

Similarly, as shown in a partially enlarged view, a parasitic capacitor 502 (capacitance value Cprs) can be formed between the signal line of the signal S2 and the signal line of the signal $V_R$. The detection element 130*b* and the parasitic capacitor 502 form a high-pass filter, and its cut-off frequency fcHR is given by $$fcHR=(2\times\pi\times Rref\times Cprs)^{-1}$$

Crosstalk noise derived from the parasitic capacitors 501 and 502 (noise mixed from the signal line of the signal S2) can be superimposed on the signals $V_M$ and $V_R$ via the high-pass filters. However, before driving of the heating element 120*a* (T=Tini), since the electric resistance values Rmes and Rref are equal to each other, the cut-off frequencies fcHM and fcHR are equal to each other. Hence, the crosstalk noise is canceled by the differential amplifier 133.

Also, another noise (so-called fluctuation noise) can be superimposed on the signals Vmes and Vref due to the fluctuation of the current amount of the current source 107. This noise can also be canceled by the differential amplifier 133.

First Example

Figure 4A:
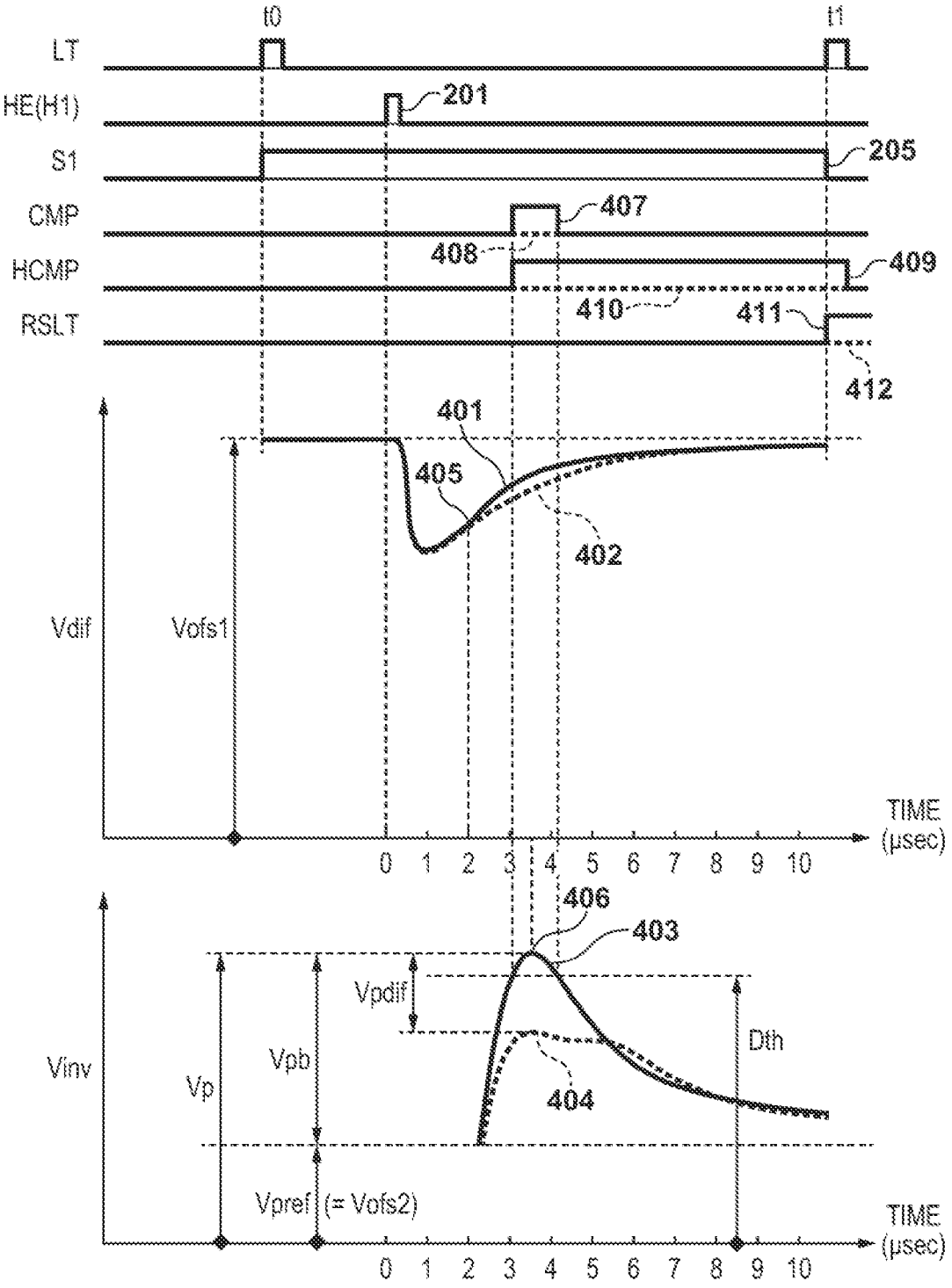
FIG. 4A is a timing chart showing the driving mode of the signal output unit.

FIG. 4A is a timing chart showing the driving mode of the signal output unit 93 as an example of this embodiment. The abscissa of FIG. 4A is the time base (here, mainly time t0 to t1), and the ordinate shows the signals LT, HE(H1), and S1, and also shows the signals CMP, HCMP, RSLT, Vdif, and Vinv at that time.

In this example, as described above with reference to FIG. 1, the voltage of one terminal of the detection element 130mes that is the temperature detection target is output as the signal $V_M$, and the voltage of one terminal of the detection element 130ref that is the comparison target is output as the signal $V_R$. After that, the signals Vmes and Vref according to the signals $V_M$ and $V_R$ are input to the inverting amplifier 135, and the signal Vdif is output.

As for the signal Vdif, after the signal H1 is activated (after the heating element 120 is driven), a waveform 401 in a case in which ink discharge is appropriately performed exhibits a relatively steep variation at a feature point 405. This is caused because a part of ink discharged from the orifice 609 (see FIG. 6) returns to the orifice 609 due to a negative pressure or viscosity. On the other hand, a waveform 402 in a case in which ink discharge is not appropriately performed exhibits a relatively moderate variation without forming the feature point 405.

If the signal Vdif has the waveform 401, the signal Vinv exhibits a waveform 403. If the signal Vdif has the waveform 402, the signal Vinv exhibits a waveform 404. In the waveform 403, a peak 406 representing the maximum variation amount of the waveform 401 after the feature point 405 appears. A voltage Vp at the peak 406 is given by $$Vp=Vpref+Vpb$$

$$(=Vofs2+Vpb)$$

The waveform 403 becomes close to the value Vpref along with the elapse of time. On the other hand, a peak that appears in the waveform 404 is smaller than the peak 406 by an amount corresponding to a voltage Vpdif.

Referring to FIGS. 1 and 2 together with FIG. 4A, the signal CMP is at H level during the period when the signal Vinv is larger than the signal Vdth, and the signal HCMP maintains H level after the timing at which the signal Vinv becomes larger than the signal Vdth. That is, as shown in FIG. 4A, the signal CMP forms a waveform 407 if Vinv>Vdth, and forms a waveform 408 otherwise. In accordance with the signal CMP, the signal HCMP forms a waveform 409 if Vinv>Vdth, and forms a waveform 410 otherwise. In accordance with the signal HCMP, the signal RSLT forms a waveform 411 if Vinv>Vdth, and forms a waveform 412 otherwise.

As described above, the signal Vdif is given by $$Vdif = Gdif \times (Vref - Vmes) + Vofs1 = Vofs1 - Gdif \times Iref \times Rs0 \times TCR \times (T - Tini)$$

That is, as is apparent from the signal Vdif shown in FIG. 4A, the waveforms 401 and 402 can relatively largely lower (vary) from the voltage Vofs1 (that is, the dynamic range is relatively large). In this example, the gain Gdif is set to $$Gdif = RD2/RD1 = 1$$

As shown in FIG. 4A, since the decrease amount of the signal Vdif from the voltage Vofs1 is relatively small, it can be said that in this case, the gain Gdif can be made larger.

Second Example

Figure 4B:
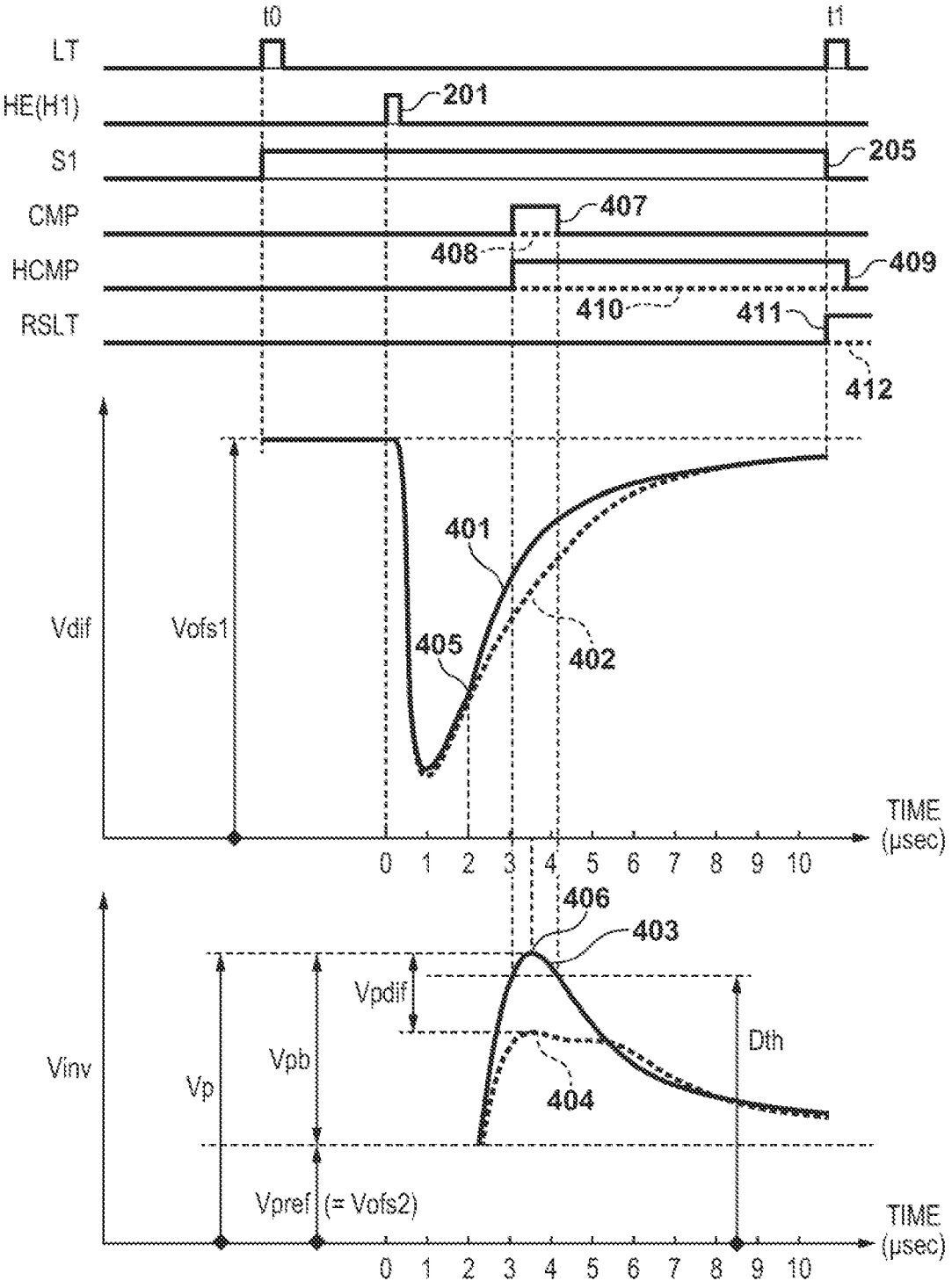
FIG. 4B is a timing chart showing the driving mode of the signal output unit.

FIG. 4B shows, as the second example, a timing chart in a case in which the gain Gdif is set to $$Gdif = RD2/RD1 = 3$$

like FIG. 4A (first example). Note that in this example, the gain Ginv of the inverting amplifier 135 is decreased to ⅓ as compared to the first example, thereby obtaining the same waveform of the signal Vinv as in FIG. 4A (first example).

In this example, the gain Gdif is made larger as compared to the first example, thereby making the decrease amount of the signal Vdif from the voltage Vofs1 relatively large, as shown in FIG. 4B. For this reason, according to this example, the signal Vdif can lower under a relatively large dynamic range. Hence, according to this example, it is possible to accurately detect the difference between the signals Vmes and Vref by the differential amplifier 133, that is, improve the accuracy of detecting whether ink is appropriately discharged.

Reference Example

Figure 4C:
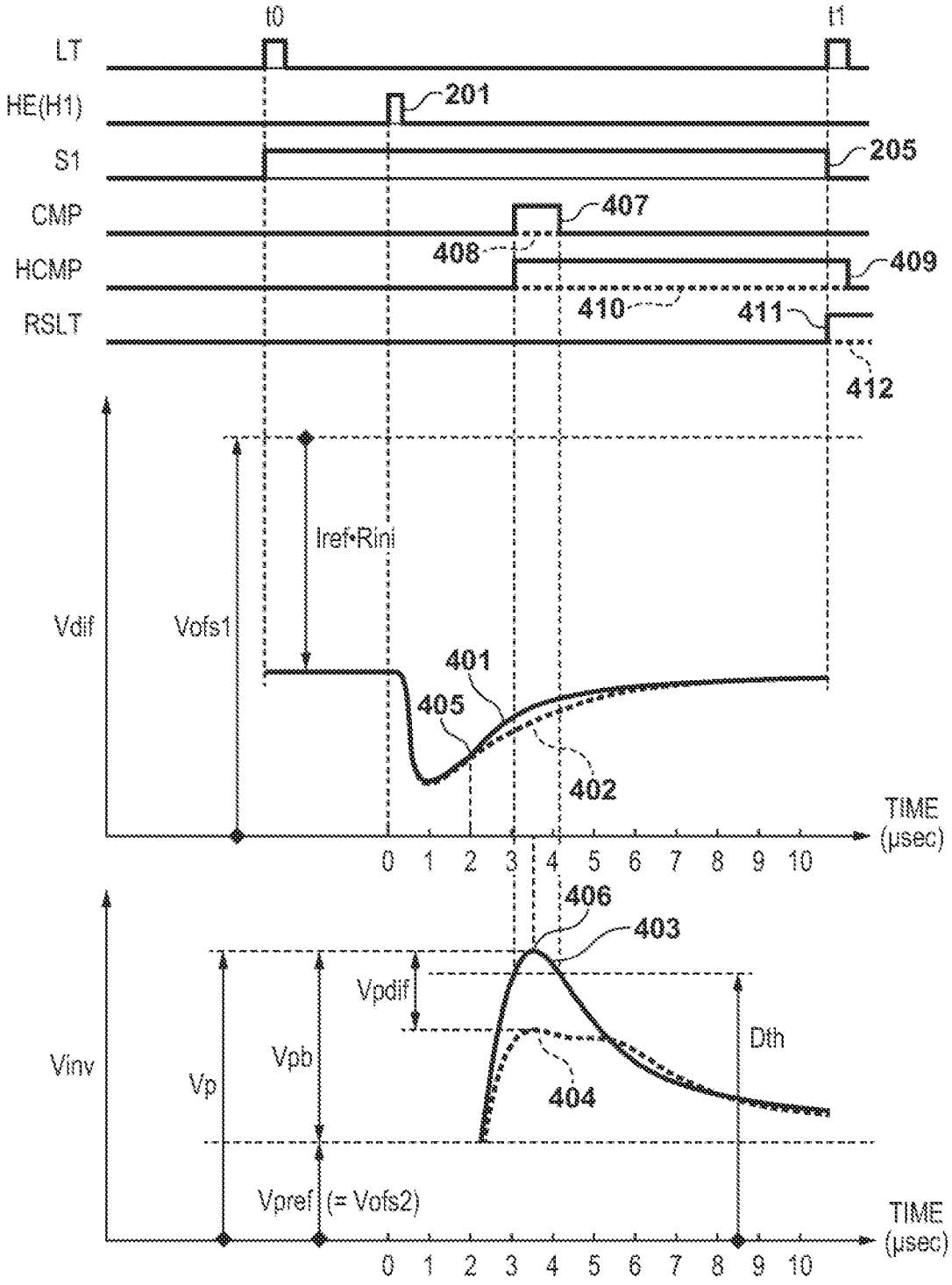
FIG. 4C is a timing chart showing the driving mode of the signal output unit.

FIG. 4C shows a timing chart as a reference example, like FIG. 4A (first example) and FIG. 4B (second example). In this reference example, a conventional configuration in which the voltage of one terminal of the detection element 130mes is output as the signal $V_M$, and the voltage of the other terminal is output as the signal $V_R$ will be considered. Here, an electric resistance value Rini of the detection element 130mes at the initial temperature Tini is given by $$Rini = Rs0 \times \{1 + TCR \times (Tini - T0)\}$$

In addition, the signal Vdif is given by $$Vdif = Vofs1 - Vmes = Vofs1 - Iref \times Rini$$

That is, in this example, it can be said that since the dynamic range of the signal Vdif becomes smaller by an amount corresponding to (Iref×Rini) as compared to the above-described first and second examples, the gain Gdif needs to be set small.

As described above, according to this embodiment, the determination signal RSLT is obtained based on the signal $V_M$ according to the voltage of one terminal of the detection element 130mes as the temperature detection target and the signal $V_R$ according to the voltage of one terminal of the detection element 130ref as the comparison target. According to this embodiment, it is possible to extend the dynamic range of the output signal Vdif as compared to the conventional configuration in which the potential difference between the terminals of the detection element 130mes is acquired as the signal RSLT. Hence, the signal RSLT can be an information signal accurately representing whether ink is appropriately discharged. Note that the other terminal of each of the detection elements 130mes and 130ref is fixed to the predetermined voltage VSS.

The controller 2 receives, from the print element substrate 1, the determination signal RSLT obtained in this way. In the controller 2, the determination unit 5 can determine, based on the signal RSLT, whether ink is appropriately discharged. This determination result is stored in the storage unit 6. Based on the determination result stored in the storage unit 6, the print control unit 4 performs feedback to a subsequent print operation, such as complementary processing and correction processing of print data when outputting it to the signal generation unit 3.

Note that in this embodiment, the number of detection elements 130 is 4 (detection elements 130*a* to 130*d*). In fact, more detection elements 130 can be arrayed. In this case, as the detection element 130ref as the comparison target, a detection element near the detection element 130mes as the temperature detection target, preferably, a detection element adjacent to the detection element 130mes is selected to reduce the influence of characteristic variations between elements that can be caused by a semiconductor manufacturing process.

To summarize, the print element substrate 1 includes the plurality of heating elements 120, the plurality of detection elements 130, the transistor 109 serving as the first current generation unit, the transistor 110 serving as the second current generation unit, and the signal output unit 93. The plurality of detection elements 130 are provided in correspondence with the plurality of heating elements 120, and each detection element 130 is configured to detect the temperature of a corresponding heating element (see FIG. 6). The transistors 109 and 110 form a part of a current mirror circuit and generate the currents Iref in amounts equal to each other (see FIG. 1). The transistor 109 can supply the current Iref to the detection element 130. The transistor 110 is provided independently of the transistor 109, and can supply the current Iref to the detection element 130, like the transistor 109.

The signal output unit 93 outputs the signal RSLT based on the detection result of the detection element 130. In this embodiment, one of the transistors 109 and 110 (for example, 109) supplies the current Iref to a certain detection element (the first detection element 130mes, for example, the detection element 130*a*) in the plurality of detection elements 130, the other (for example, 110) supplies the current Iref to another detection element (the second detection element 130ref, for example, the detection element 130*b*), and the signal RSLT obtained by this is output from the signal output unit 93. The signal RSLT exhibits a value according to the potential difference between one terminal of the first detection element 130mes (the terminal on the side where a potential variation occurs upon supply of the current Iref) and one terminal of the second detection element 130ref (the terminal on the side where a potential variation occurs upon supply of the current Iref).

Here, of the plurality of heating elements 120, a heating element corresponding to the first detection element 130mes is defined as a first heating element (for example, the heating element 120*a*), and a heating element corresponding to the second detection element 130ref is defined as a second heating element (for example, the heating element 120*b*). At the time of output of the signal RSLT, one (for example, 120*a*) of the first heating element 120*a* and the second heating element 120*b* is driven, and driving of the other (for example, 120*b*) is suppressed.

In this embodiment, during driving of a certain heating element 120, the potential difference between the voltage of the corresponding detection element 130mes and the voltage of another detection element 130ref different from that is preferably output as the signal RSLT. Hence, it is preferable that one current generation unit (transistor 109) can supply a current to each of the plurality of detection elements 130, and during this time, the other (transistor 110) can supply a current to the detection element 130ref corresponding to the heating element 120 that is not a driving target. Hence, it can be said that at least some of the plurality of detection elements 130 are preferably provided to selectively receive a current from the transistors 109 and 110.

According to this embodiment, it is possible to extend the dynamic range of the output signal Vdif as compared to a conventional configuration in which a signal representing the potential difference between the terminals of each detection element 130 is output (see FIGS. 4A to 4C). This makes it possible to amplify the signal by a relatively large amplification factor and accurately detect or determine, based on a change of the signal, whether a liquid is appropriately discharged.

(Others)

In the above description, the printing apparatus 801 using an inkjet printing method has been taken as an example and described, but the printing method is not limited to the above-described mode. Further, the printing apparatus 801 may be a single-function printer having only a printing function, or a multifunction printer having a plurality of functions such as a printing function, a facsimile function, and a scanner function. Furthermore, the printing apparatus may be, for example, a manufacturing apparatus for manufacturing a color filter, an electronic device, an optical device, a microstructure, or the like by a predetermined printing method.

The term "printing" in this specification should be interpreted in a broad sense. Accordingly, the mode of "printing" does not matter whether the object formed on a print medium is significant information such as characters and graphics, and also does not matter whether the object is visualized so that a human can visually perceive it.

Further, "print medium" should be interpreted in a broad sense, similar to "printing" described above. Accordingly, the concept of "print medium" can include, in addition to paper which is generally used, any member that can accept ink, such as cloth, a plastic film, a metal plate, glass, ceramics, a resin, wood, leather, and the like.

Furthermore, "ink" should be interpreted in a broad sense, similar to "printing" described above. Accordingly, the concept of "ink" can include, in addition to a liquid that forms an image, a figure, a pattern, or the like by being applied onto a print medium, additional liquids that can be used for processing a print medium, processing ink (for example, coagulation or insolubilization of colorants in ink applied onto a print medium), or the like.

The present invention is not limited to the above embodiments and various changes and modifications can be made within the spirit and scope of the present invention. Therefore, to apprise the public of the scope of the present invention, the following claims are made.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-099609, filed on Jun. 8, 2020, which is hereby incorporated by reference herein in its entirety.

What is claimed is:

1. A print element substrate comprising:

a plurality of heating elements each capable of generating heat energy;

a plurality of detection elements which correspond to the plurality of heating elements and each of which can detect a temperature of a corresponding heating element;

a first current generation unit;

a second current generation unit different from the first current generation unit; and a signal output unit, wherein one of the first current generation unit and the second current generation unit supplies a current to a first detection element in the plurality of detection elements, the other of the first current generation unit and the second current generation unit supplies a current to a second detection element in the plurality of detection elements, and the signal output unit outputs a signal according to a potential difference between one terminal of the first detection element on a side where a potential variation occurs upon supply of the current and one terminal of the second detection element on a side where a potential variation occurs upon supply of the current.

2. The substrate according to claim 1, wherein, when, of the plurality of heating elements, a heating element corresponding to the first detection element is defined as a first heating element, and a heating element corresponding to the second detection element is defined as a second heating element, at the time of output of the signal by the signal output unit, one of the first heating element and the second heating element is driven, and driving of the other is suppressed.

3. The substrate according to claim 1, wherein the first current generation unit and the second current generation unit form a part of a current mirror circuit.

4. The substrate according to claim 1, wherein at least some of the plurality of detection elements are provided to selectively receive the current from the first current generation unit and the second current generation unit.

5. The substrate according to claim 1, wherein the plurality of heating elements are configured to be drivable time-divisionally.

6. The substrate according to claim 1, wherein each of the plurality of heating elements and the plurality of detection elements is a resistive element.

7. The substrate according to claim 6, wherein each of the plurality of detection elements is provided to face a corresponding heating element in a planar view.

8. A printhead comprising a print element substrate defined in claim 1, and a plurality of nozzles corresponding to a plurality of heating elements and provided to discharge a liquid.

9. A printing apparatus comprising a printhead defined in claim 8, and a controller configured to perform driving control of the printhead.

10. The apparatus according to claim 9, wherein the controller performs driving control of the printhead based on a signal from a signal output unit.

* * * * *